United States Patent [19]
Moore
[11] 4,214,791
[45] Jul. 29, 1980

[54] METHOD FOR IMPROVING SOLUTION FLOW IN SOLUTION MINING OF A MINERAL

[75] Inventor: Thomas F. Moore, Richardson, Tex.

[73] Assignee: Atlantic Richfield Company, Los Angeles, Calif.

[21] Appl. No.: 972,293

[22] Filed: Dec. 22, 1978

[51] Int. Cl.[3] ..... E21B 43/28
[52] U.S. Cl. ..... 299/4; 166/307; 299/5
[58] Field of Search ..... 299/4, 5; 166/307, 271

[56] References Cited

U.S. PATENT DOCUMENTS

| | | | |
|---|---|---|---|
| 3,278,233 | 10/1966 | Hurd et al. | 299/4 |
| 3,881,774 | 5/1975 | Van Poolen | 299/4 |
| 4,043,599 | 8/1977 | Lingane et al. | 299/4 |

*Primary Examiner*—William F. Pate, III
*Attorney, Agent, or Firm*—Ronnie D. Wilson

[57] ABSTRACT

The present invention relates to an improved method for the solution mining of a mineral from a subterranean formation. More specifically, the invention relates to an improved method which enhances significantly the recovery of a mineral from a subterranean formation via solution mining by increasing the rate of reactant flow through the formation via improved formation permeability and thereby reducing the time necessary to recover the mineral values therefrom.

6 Claims, No Drawings

METHOD FOR IMPROVING SOLUTION FLOW IN SOLUTION MINING OF A MINERAL

Generally, known methods for the solution mining of a mineral in situ utilize an acid or alkaline leach solution for the dissolution of the mineral. An oxidant is injected into the formation along with the leach solution. The mineral is leached from the formation and recovered from a production well via a pregnant leach solution. Various procedures for recovering the mineral from the pregnant leach solution are well known, such as ion exchange.

The process of the present invention is particularly suitable for the leaching of uranium; however, my invention is not so limited. The following description of the present invention will be applied to uranium leaching; however, it is apparent that it is applicable to leaching other mineral values such as copper, nickel, molybdenum, rhenium and selenium where similar problems are encountered.

It is well known that to increase the recovery of uranium from an underground ore body, it is necessary to convert the relatively insoluble tetravalent state of uranium in the ore to the solubilizable hexavalent state. When using an acid leach solution, the dissolution of the uranium in solution occurs in two steps. The first step involves the oxidation of uranium and the second the dissolution of the oxidized uranium into the solution.

During a leaching operation utilizing solutions of sulfuric acid, hydrochloric acid, and other mineral acids in conjunction with the typical oxidants of air, oxygen, and hydrogen peroxide, uranium is oxidized and dissolved. Both the oxidation rate of uranium and the dissolution rate of the oxidized uranium are dependent on the rate at which the reactants are introduced into the mineral-bearing formation.

It has been found that tyically uranium-bearing formations contain a finite quantity of clay minerals. The clay mineral types include both swelling clays, such as montmorillonite and dispersive clays, such as kaolinite and chlorite, as well as illite. It has further been found that such clays are sensitive to changes in both the concentration and types of cations introduced into the formation containing same during an in situ uranium leaching operation. The introduction of sodium ions in quantities sufficient to alter the sodium-divalent cation ratio in the formation fluid during a leaching operation has resulted in swelling of the montmorillonite and thereby causing a corresponding loss in permeability. This causes decreased oxidation and dissolution of uranium and lower maximum concentration of uranium in solution while leaching through the formation.

Therefore, there is needed a method whereby a formation containing a mineral such as uranium can be leached with a leach solution without being accompanied by excessive losses of formation permeability and a diminishing rate of mineral recovery.

Therefore, it is an object of the present invention to provide an improved method for the solution mining of a mineral from a subterranean formation, applicable generally to minerals requiring acid leach solutions.

An additional object of the present invention is to provide an improved method for the solution mining of a mineral from a subterranean formation, applicable generally to minerals requiring oxidation and acid leach solutions.

A further object of the present invention is to provide an improved method for the solution mining of uranium.

It is an additional objective of the present invention to provide an improved method for the solution mining of uranium from subterranean deposits which provides a higher rate of reactant flow through the formation and thereby provides better formation permeability for the oxidation of uranium and subsequent dissolution thereof.

Gases in general have a lower viscosity than liquids. Therefore, the injection of acid forming gases can be utilized in solution mining to increase the rate of reactant addition to a mineral-bearing formation. Oxygen or other oxidant gas can be mixed with an acid forming gas to control the latter's partial pressure and hence the amount that can dissolve in the residual water in a formation.

Recent studes have shown that the uranium oxidation rate is a direct function of the available oxygen concentration in the formation. Therefore, the rate of uranium production and the uranium concentration in the effluent of the in situ leaching operation are determined to a significant degree by the amount of oxidant available to oxidize uranium at any location in the uranium-bearing formation. The more oxidant available, the faster the rate of uranium oxidation and the greater the uranium concentration in the pregnant solution.

Since lack of permeability in a formation inhibits the flow of leaching solution and oxidant through the formation, such a lack reduces the available oxidant and in conjunction therewith a reduced amount of uranium oxidation and dissolution and thereby decreases the uranium concentration in the pregnant solution.

My studies demonstrate that an increased uranium production can be achieved by improving the permeability of a subterranean formation prior to an in situ leaching operation, thereby allowing an increased supply of oxidant and leach solution for the uranium minerals present in a formation.

The rate of uranium oxidation, dissolution and, hence, production in a pattern is greatly increased by the inhibition of swelling and dispersion of the cays contained therein. An improvement in the permeability of the formation of from 5 to 95 percent could increase the production of uranium by 500 percent or more.

This improvement can be effected by introducing an acid gas into the formation prior to mining with a leach solution. By treating the formation with an acid gas prior to solution mining, the various clays present will shrink and the permeability of the formation will be increased.

It has been found that in order to obtain the desired results from the use of an acid gas one should utilize it as a pretreatment prior to the actual leaching operation.

Acid gases suitable for the present invention include hydrochloric, sulfur trioxide, sulfur dioxide and carbon dioxide.

Therefore, through the utilization of the present invention, the recovery of uranium via in situ leaching processes, is enhanced significantly by most effectively using the acid gases to improve the permeability of a given formation. The present invention is most effective in formations of very low permeability which, if left untreated, would require an extensive period of time to solution mine.

Having thus described my invention, I claim:

1. An improved method for the solution mining of a mineral from a subterranean formation containing same in which an injection and production well are drilled and completed within said formation, leach solution and an oxidant are injected through said injection well into said formation to dissolve said mineral, and said dissolved mineral is recovered via said production well, wherein the improvement comprises pretreating said formation with an acid gas to improve the permeability thereof.

2. The improvement of claim 1 wherein said acid gas is selected from the group consisting of hydrochloric, sulfur trioxide, sulfur dioxide and carbon dioxide.

3. The improvement of claim 1 wherein said mineral is selected from the group consisting of copper, nickel, molybdenum, rhenium, selenium and uranium.

4. The improvement of claim 1 wherein said leach solution is acidic in nature.

5. The improvement of claim 4 wherein said acid leach solution is selected from the group consisting of hydrochloric and sulfuric acid.

6. The improvement of claim 1 wherein said oxidant is selected from the group consisting of air, oxygen and hydrogen peroxide.

* * * * *